US005491892A

United States Patent [19]

Fritz et al.

[11] Patent Number: 5,491,892

[45] Date of Patent: Feb. 20, 1996

[54] METHOD AND APPARATUS OF MOUNTING A PACKAGE HOUSING AND GROUND STRAP

[75] Inventors: Todd W. Fritz, Kalamazoo; Mark L. Lanting, Portage; Alan R. Davis, Plainwell; Stephen A. Edelen, Battle Creek; Jack D. Patterson, Kalamazoo, all of Mich.

[73] Assignee: Eaton Corporation, Cleveland, Ohio

[21] Appl. No.: 260,390

[22] Filed: Jun. 16, 1994

[51] Int. Cl.[6] ..... H01R 43/00

[52] U.S. Cl. ..... 29/857; 174/51; 439/92; 439/384

[58] Field of Search ..... 29/857, 860, 861, 29/863; 174/51; 439/92, 96, 382, 384, 385

[56] References Cited

U.S. PATENT DOCUMENTS 4,161,747 7/1979 Jennings ..... 357/82

4,960,964 10/1990 Schnell et al. ..... 174/51

5,115,862 5/1992 Hastings ..... 174/51

*Primary Examiner*—P. W. Echols

*Attorney, Agent, or Firm*—Jennifer M. Stec; Howard D. Gordon

[57] ABSTRACT

A ground strap and vibration mount assembly (10) effectively mechanically isolates an electronic component from vibration while also providing an electrically conductive path to ground potential. The assembly (10) includes a vibration dampener (16) mounted through an opening (28) formed in a tab (12) projecting from the housing of the vibration sensitive electronic component. An insert (18) is provided therein and a mounting bolt (54) is positioned through a suitable opening (36) formed through the insert (18). An electrically conductive ground strap (40) is wrapped partially around the tab (12). An aperture (52) is formed in one portion (50) of the strap (40) and the bolt (54) passed therethrough. Opposing ends (42) of the electrically conductive connector (40) are secured to the tab (12).

13 Claims, 2 Drawing Sheets

FIG 1
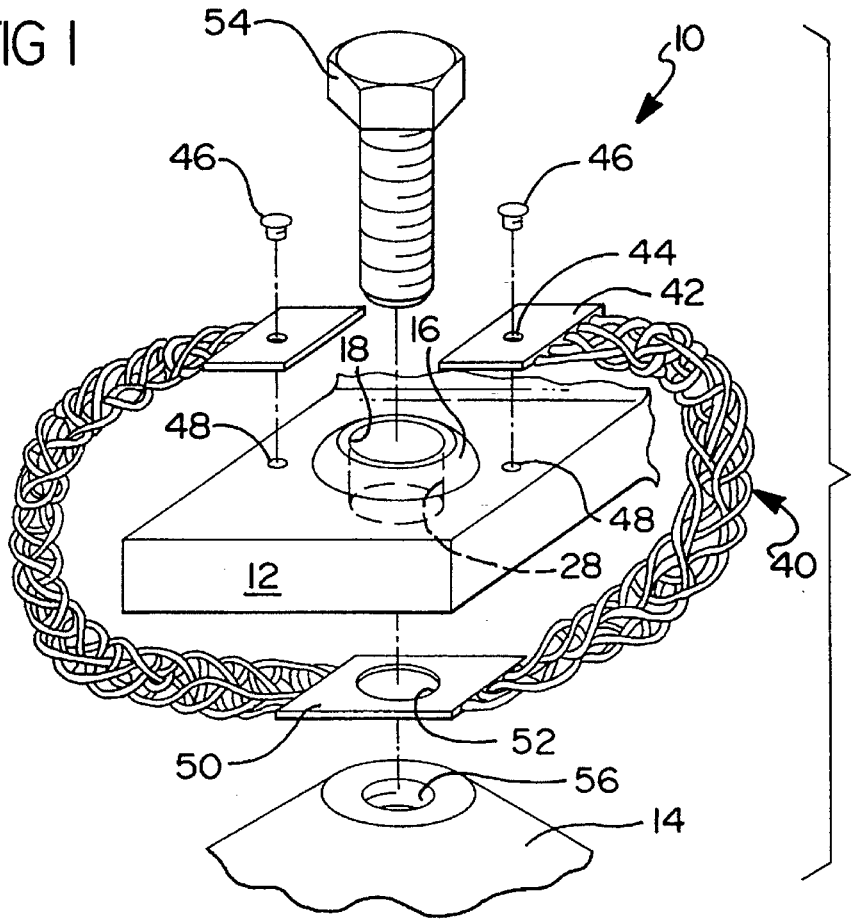
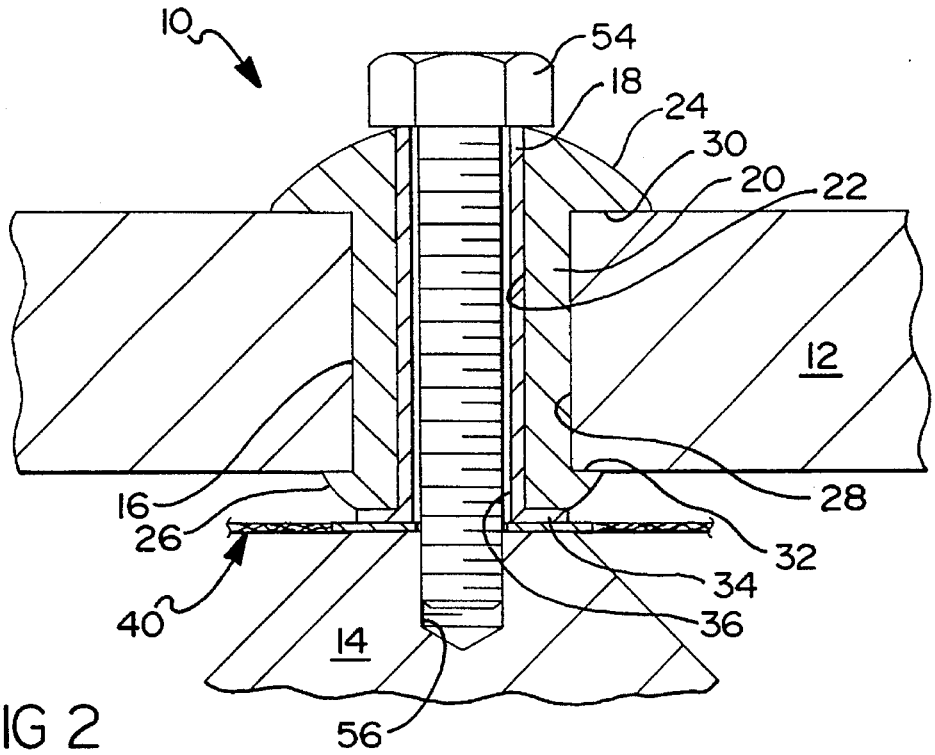
FIG 2

FIG 3
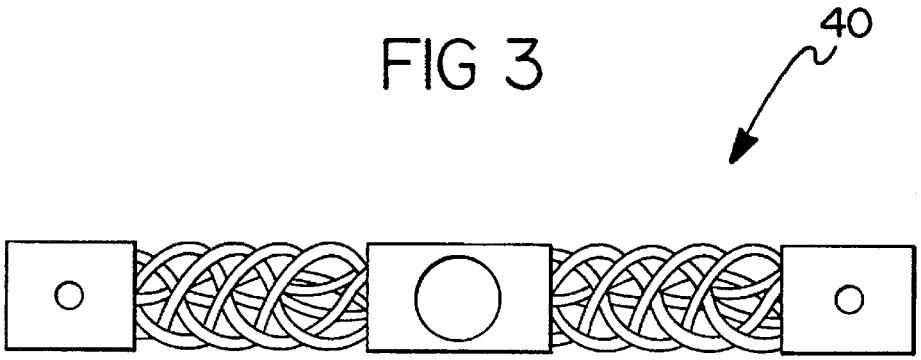
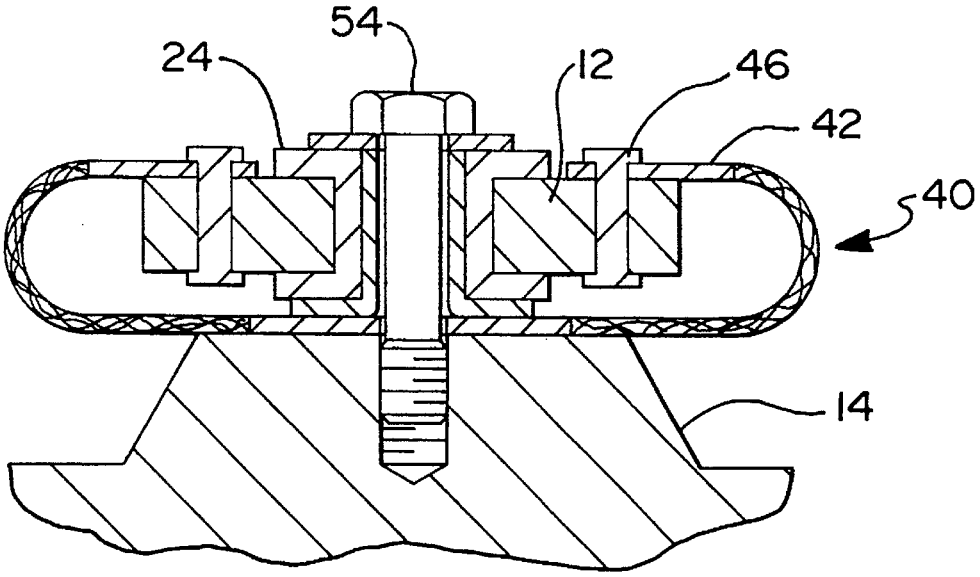
FIG 4

METHOD AND APPARATUS OF MOUNTING A PACKAGE HOUSING AND GROUND STRAP

BACKGROUND OF THE INVENTION

The present invention relates generally to an integrated assembly for mounting an electronic package to a mechanical component while providing vibration isolation as well as an electrical ground.

An electronic control unit or other component, when mounted on a drive line or power flow component of a transportation vehicle, is often exposed to high levels of mechanical shock transients and vibration. To prevent loss of function of the electronic assembly due to stress failure which can result from such a vibration rich environment, the electronic package is usually mounted on a resilient energy absorbing or dampening material. As such vibration mount materials are typically electrically nonconductive, a separate highly conductive ground connection is then made between the electronic component and the vehicle electrical system. This connection is typically made through the vehicle's frame or powertrain to provide a "chassis ground", which effectively decouples electrical noise or interference between the mounted electronic component and other vehicle electrical systems, in order to reduce undesired performance variations.

However, the use of separate vibration isolation and electrical grounding components in this type of application can present several difficulties. For instance, the separate ground connection can sometimes inadvertently be omitted in the assembly process. Also, the ground connection may not be securely fastened. While an integrated mount, in the form of heavy conductive aircraft wire formed into a spring, has in the past been used to mount an electrical package to a mechanical component and to thereby provide both vibration isolation and an electrical ground, this type of connector has been found to possess several inherent disadvantages. The most notable of these disadvantages are cost and conductive capability. While conductive fibers can be added to the vibration mounting material to improve electrical conduction, this has not proven to be cost effective and the results have not been satisfactory for the suppression of currents involved in electromagnetic interference and electrostatic discharge.

Therefore, there exists a need for an improved vibration isolation and chassis ground connection assembly useful in mounting an electronic control unit to a vehicle mechanical component. Such assembly must be effective in addition to being relatively inexpensive, easy to manufacture and easy to install. It would also be desirable to provide an assembly which reduces the possibility of installation without all components being intact.

SUMMARY OF THE INVENTION

The present invention addresses this need by providing a mounting assembly which effectively mechanically isolates a packaged electronic component from vibration while also providing an electrically conductive path from the electronic component to ground potential. The assembly includes a resilient vibration dampening mount positioned in an opening formed through a projecting tab of the electronic component housing or package. An insert is provided in the dampener and a threaded bolt passes through a suitable opening formed through the insert. An electrically conductive ground strap having an aperture formed therethrough is wrapped substantially around the component package tab. The threaded bolt passes from the insert opening through the ground strap aperture and into engagement with a threaded bore in the vehicle mechanical component.

This vibration dampening and ground connection assembly thus provides a simple and effective means to mount and ground a packaged electronic component to a vehicle mechanical component. Inadvertent omission of the ground strap is made less likely by requiring the ground strap to be fastened between the dampener and the mechanical component. The ground strap is thus held securely therebetween for increased reliability. Further advantages and features of this invention will become apparent from the following specification taken in conjunction with the accompanying drawings.

BRIEF DESCRIPTION OF THE DRAWINGS

FIG. 1 is an exploded isometric view of the ground strap and vibration mount assembly of the present invention, as employed in a typical application.

FIG. 2 is a partial sectional view of the assembly illustrated in FIG. 1, taken generally through the center of the vibration mount.

FIG. 3 is a detailed plan view of the conductive ground strap.

FIG. 4 is a partial sectional view similar to FIG. 2 further including ground strap 40.

DETAILED DESCRIPTION OF THE PREFERRED EMBODIMENT

Referring now to the drawings, and in particular to FIG. 1, a mounting assembly made in accordance with the present invention, in this instance used in securing an electronic control unit to a vehicle transmission housing, is indicated generally at 10. The components of assembly 10 are utilized to mechanically secure a protruding tab 12 of an electronic device housing or package to an appropriately fashioned mounting boss 14 of a powertrain or other vehicular component. Preferably, the electronic device housing includes a plurality of tabs 12, each to be secured to a separate mounting boss 14.

Vibration isolation or dampening between each boss 14 and electronic package tab 12 is performed primarily by a vibration dampening mount 16 having positioned therein a strengthening insert 18. The configuration of mount 16 and insert 18 is illustrated more clearly in the cross-sectional view of FIG. 2. As shown therein, vibration dampening mount 16 includes a generally cylindrically shaped body 20 having an interior bore 22 formed therethrough. Body 20 is positioned between an enlarged rounded head 24 and a smaller enlarged foot 26, through which interior bore 22 also extends. Head 24 is spaced along cylindrical body 20 from foot 26 so as to retain tab 12 therebetween, dampener mount body 20 preferably being retained by friction in a suitable opening 28 which has been formed through tab 12. Tab 12 preferably fits securely between surfaces 30 and 32 of dampener head 24 and foot 26, respectively.

Vibration mount 16 is preferably made of a rubber or other resilient material and in the present embodiment is an off-the-shelf product, part number J-20433-3, manufactured by Lord Corporation of elastomer B050A, a synthetic rubber. Insert 18 is preferably formed of a rigid metallic material such as steel and fits by press fit within dampener interior bore 22. Insert 18 is likewise substantially cylindrically shaped, but having one flattened flared end 34. When insert 18 is positioned within dampener 16, flared end 34 sits just outside dampener foot 26 against a surface thereof opposite surface 32.

Returning back to FIG. 1, an electrical grounding connection between the electronic package and the vehicle chassis is made via a ground strap 40. Ground strap 40 is made of a highly electrically conductive material, in the presently preferred embodiment a flexible metallic material such as a heavy duty tinned copper braid, readily commercially available. Strap 40 is preferably of a length to fit substantially circumferentially around package tab 12. As shown in FIG. 3, the braided material of strap 40 has at each end, a flat portion 42 for use in securing each end of strap 40 to package tab 12. In the present embodiment each flat end portion 42 is formed by crimping flat a length of tinned copper tube, with the braid material captivated therein, and then punching a hole 44 therethrough. This configuration helps to prevent fraying on the ends of strap 40 and provides a compression surface for mounting screws. Alternately, however, flat portions 42 may be formed by simply crimping flat an end of the metallic braid of strap 40 and forming hole 44 through the crimped braid.

Strap 40 is preferably secured to package tab 12 at each end thereof, such as by rivets 46 which pass through holes 44 in strap 40 and holes 48 formed into package tab 12. The rivet head is expanded on the bottom side of package tab 12 providing a permanent assembly as shown in detail in FIG. 4. Rivets 46 are in the presently preferred embodiment formed of the same material as the electronic package, preferably aluminum, so as to avoid thermal expansion and contraction problems that may be created when riveting dissimilar metals. Alternately, threaded fasteners could be used in place of rivets 46 or a pair of rivets could be used to secure each end of strap 40.

Strap 40 preferably further has formed therein a further crimped section 50, formed intermediate flat portions 42, in the present instance approximately at the midpoint of strap 40. However, depending on the configuration of package tab 12, and the manner in which strap 40 is wrapped therearound, crimp 50 is formed on a portion of strap 40 wherein when strap 40 is disposed about tab 12, crimp 50 is aligned with insert 18.

Crimped area 50 further has formed therethrough, such as by punching, an aperture 52. Aperture 52 is formed so as to be coincident with the opening formed through insert 18 such that a mounting bolt 54, again preferably aluminum, passes through vibration mount 16 through strap 40 and into a threaded bore 56 formed in mounting boss 14. Mounting boss 14 preferably has a machined surface against which the relatively soft material of strap 40 mount is compressed, thereby providing an airtight electrical connection in order to deter any impedance change due to corrosion. In order to provide redundancy in the electrical grounding connection, a pair of straps 40 may be used, preferably disposed at approximately right angles to one another.

Ground strap 40 is preferably manufactured by slipping a number of precut sections of hollow tubing onto a length of metallic braid sufficient to make a number of straps 40. The tubing segments are spaced from one another such that a first section of tubing may be crimped flat and then cut in half to form a pair of flat end portions 42, each of which belongs to a separate strap 40. Into each end portion 42 is punched a hole 44, either prior to or after separation. An adjacent tube segment is crimped and punched to form intermediate segment 50 and aperture 52. A next tubing segment is flattened to form another end portion 42 and that of an adjoining strap 40.

In mounting tab 12 to boss 14, dampener 16 is preferably insertably forced into opening 28 of tab 12 by compressing foot 26. Insert 18 is then preferably forced upward into interior bore 22 of dampener 16 until flared end 34 of insert 18 rests upon dampener foot 26. Aperture 52 of ground strap 40 is then aligned between insert 18 opening 36 and mounting boss 14 threaded bore 56. A threaded mounting bolt 54 is passed through insert 18 and aperture 52 and then into threaded engagement with the threaded bore 56 formed in mounting boss 14. Bolt 54 is tightened to provide an optimum amount of force against dampener head 24 with insert 18 preventing excessive compression of dampener mount 16. Since insert opening 36 is not threaded, bolt 54 fits therethrough by clearance fit. Once strap 40 is retained via aperture 52, end portions 42 are brought onto tab 12 and retained by threaded fasteners 46.

The present assembly 10 thus provides an improved means for mounting a vibration sensitive electronic package to a vibration prone mechanical component while also providing a suitable ground connection. The design is such that mounting the electronic package without ground strap 40 is made less probable, thereby avoiding inadvertent omission of a separately attached ground strap.

The foregoing discussion discloses and describes an exemplary embodiment of the present invention. One skilled in the art will readily recognize from such discussion, and from the accompanying drawings and claims, that various changes and modifications can be made therein without departing from the spirit and scope of the invention as defined in the following claims.

It is claimed:

1. An apparatus for mounting a component package housing at least one electronic component to a mounting boss formed in a mechanical component, said component package including at least one tab projecting outwardly therefrom, said tab having a package tab bore formed therethrough, said apparatus comprising:

a resilient dampening member positioned in said package tab bore, said dampening member including a rigid insert;

a conductive ground strap, said strap having two ends, each said end being secured to a surface of said tab, said strap also having a portion intermediate said ends having a ground strap aperture formed therein, said aperture being aligned with said package tab bore; and a fastener passing through said dampening member insert, said ground strap aperture and into said mounting boss.

2. The apparatus of claim 1 wherein said ground strap is formed of a conductive metallic braid, said braid having a flattened portion surrounding said aperture and at each said end.

3. The apparatus of claim 2 wherein each said flattened portion is formed by crimping flat a length of metal tubing captivating said metallic braid therein.

4. The apparatus of claim 2 wherein each said end flattened portion has a hole formed therethrough, said ends being secured to said package tab via a fastener passing through said hole.

5. The apparatus of claim 1 wherein said resilient dampening member includes a cylindrically shaped body having an enlarged head at one end thereof and an enlarged foot at an opposite end, said head being spaced from said foot along said body so as to retain said tab therebetween.

6. The apparatus of claim 5 wherein said insert is substantially cylindrically shaped, having a flared end, said insert body extending through said dampener with said flared end disposed outside said dampener foot.

7. The apparatus of claim 6 wherein said ground strap is compressed between said insert end and said mounting boss.

8. The apparatus of claim I wherein said fastener is a threaded bolt and said bolt threadingly engages a threaded hole formed in said mounting boss.

9. A method of mounting an electronic component package housing at least one electronic component to a mounting boss formed in a mechanical component, said electronic component package including at least one tab projecting outwardly therefrom, said tab having a tab bore formed therethrough, said method comprising the steps of:

providing a vibration dampening member including an insert having an insert opening formed therethrough;

positioning said dampening member in said tab bore;

providing a conductive ground strap having at least one ground strap aperture formed therethrough;

aligning said insert opening with said ground strap aperture; and fastening said dampening member to said boss through said ground strap aperture.

10. The method of claim 9 wherein said ground strap has two ends and further including the step of fastening each said end to said tab.

11. The method of claim 9 wherein said ground strap is formed of a conductive metallic braid.

12. The method of claim 9 wherein said dampener is fastened to said mounting boss with a threaded bolt.

13. The method of claim 9 further including the step of providing said dampening member with a cylindrical body having an enlarged head at one end thereof and an enlarged foot at an opposite end and wherein said top is positioned with respect to said dampening mount intermediate said head and foot.

* * * * *